United States Patent [19]

Woudenberg

[11] Patent Number: 4,616,225

[45] Date of Patent: Oct. 7, 1986

[54] PORTABLE TRAFFIC CONTROL SIGNAL DEVICE

[75] Inventor: John D. Woudenberg, Phoenix, Ariz.

[73] Assignee: Material Sales, Inc., Tempe, Ariz.

[21] Appl. No.: 480,919

[22] Filed: Mar. 31, 1983

[51] Int. Cl.[4] ..... G08G 1/095

[52] U.S. Cl. ..... 340/908; 116/63 P; 212/182; 414/680

[58] Field of Search ..... 212/182; 116/63 R, 63 P; 340/908, 907; 414/680, 728

[56] References Cited

U.S. PATENT DOCUMENTS

| | | | |
|---|---|---|---|
| 2,109,286 | 2/1938 | Cubby | 116/63 P |
| 2,941,185 | 6/1960 | Mullikin | 116/63 P |
| 3,995,250 | 11/1976 | Ferree | 340/908 |
| 4,044,902 | 8/1977 | Eitel | 414/680 |
| 4,394,108 | 7/1983 | Cook | 414/680 |
| 4,419,038 | 12/1983 | Pendergraft | 212/266 |
| 4,430,638 | 2/1984 | Parker | 116/63 P |

*Primary Examiner*—John W. Caldwell, Sr.
*Assistant Examiner*—Michael F. Heim
*Attorney, Agent, or Firm*—Gregory J. Nelson

[57] ABSTRACT

A portable traffic control unit comprising a wheeled trailer having a main frame attachable to a towing vehicle. A telescoping, vertical mast carries a pivotally mounted boom assembly. A first traffic control signal is secured to the vertical mast and a second at the end of the horizontal boom. A winch assembly can be actuated to raise the vertical mast and upon the vertical mast reaching its full extension, causing the boom to pivot to a generally horizontal position. In the erected position, the device provides a street side signal and an over-the-road traffic control signal for safety and visibility.

5 Claims, 11 Drawing Figures

FIG. 6A
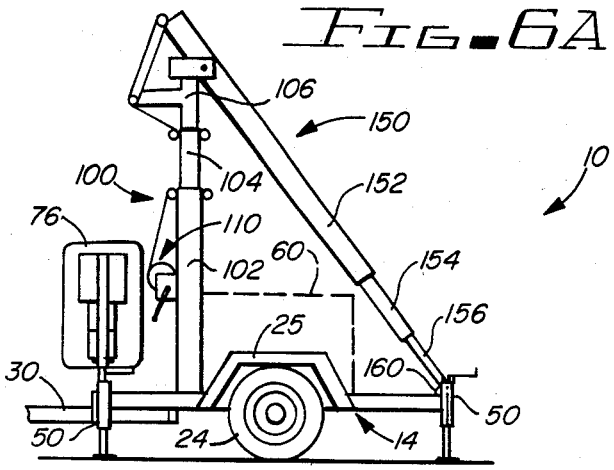
FIG. 6B
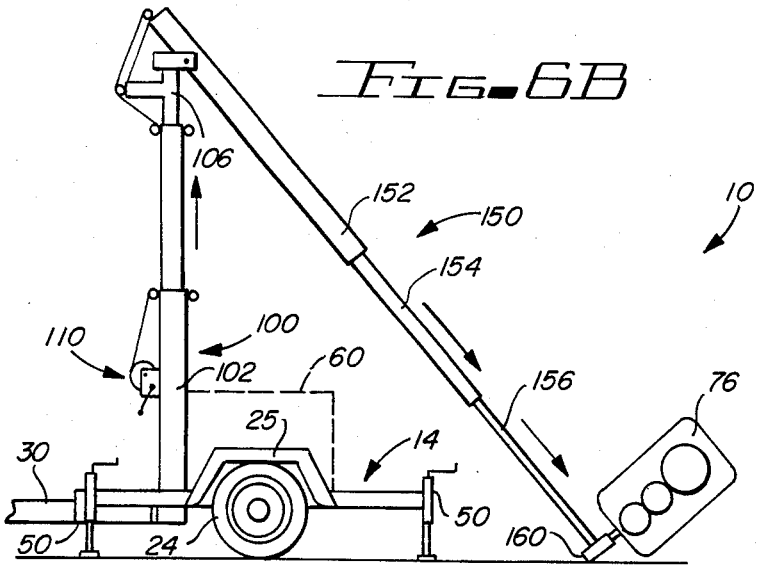
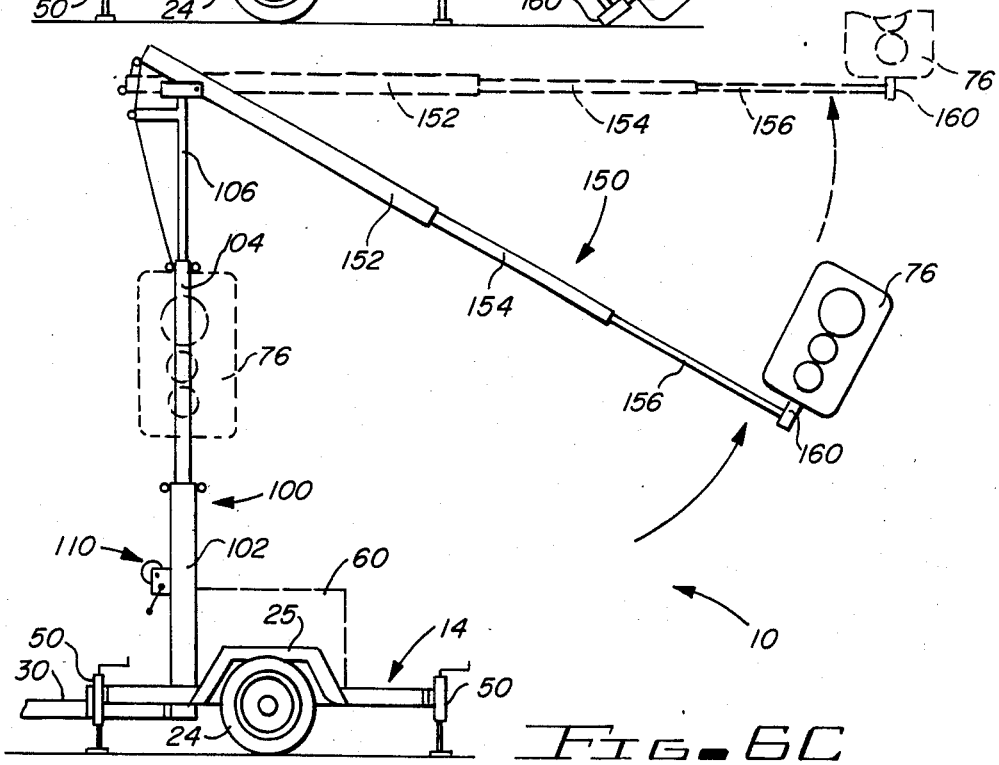
FIG. 6C

PORTABLE TRAFFIC CONTROL SIGNAL DEVICE

The present invention relates to a traffic control signal device and more particularly relates to a portable traffic control signal for temporary location on streets and highways.

Various types of portable traffic signals have been employed in the prior art. Typical of these are the portable traffic signals shown in the following U.S. Pat. Nos.:

| No. | Title | Inventor |
|---|---|---|
| 2,941,185 | Portable Traffic Signal | Mullikin |
| 3,995,250 | Portable Traffic Signal Light | Ferree |
| 4,032,883 | Portable Traffic Signal | Gibson |
| 3,046,521 | Portable Traffic Signal System | Cantwell |
| 2,401,940 | Portable Traffic Signal | Lange |

Signals of this general type are utilized when a temporary traffic control device is needed. For example, portable devices are often used at construction sites where road repairs are underway or where traffic has to be temporarily re-routed for a period of time to permit construction to proceed.

Another use of portable traffic control devices is in situations where a traffic accident, a storm or some other situation has caused a temporary malfunctioning of permanent traffic control devices. This often happens as a result of a vehicle striking the support for the traffic control signal. When this occurs, it is necessary to utilize a temporary, portable control until the permanent signal can be repaired to avoid traffic accidents and congestion.

Another use of temporary devices is for special events such as athletic events and the like where a traffic signal is required or needed only to control traffic periodically. In this situation, the cost of a full time signal generally cannot be justified, particularly where the governmental subdivisions are operating under restricted budgetary constraints.

As pointed out above, there are a substantial number of circumstances where portable or temporary devices are needed. The alternative to a temporary system is to utilize police officers for traffic direction and control. While, as mentioned above, some portable traffic signals are found in the prior art, they generally have not found wide acceptance. The prior art temporary traffic control devices involve equipment or designs which do not meet highway department standards and are not effective for their intended purpose. Another shortcoming is that prior art devices generally only provide a single, roadside signal device in contrast to most permanent systems which also include a signal over the roadway for increased safety and visibility.

Accordingly, there exists a need for an effective, portable traffic control signal which may be easily transported and erected at a desired location and removed with a minimum of time. Further, there exists a need for a signal of this general type which is efficient and easy to operate. Further, there exists a need for a device of the general type which provides a traffic control signal both at the roadside and over the roadway for improved visibility and traffic control.

Accordingly, the present invention provides a traffic control signal which is portably mounted on an appropriate trailer. The trailer can be attached by means of a hitch to any convenient towing vehicle. The signal device includes a vertically telescoping mast assembly which carries a first traffic control signal. The mast can be extended by a winch or other power means and locked at the desired height. When this is accomplished, a telescoping boom is pivotally raised to a horizontal position and extended so the end of the boom is over the roadway. A second traffic signal device is carried on the end of the boom to be positioned over the roadway. The trailer may include its own electrical generation system or may be attached to a source of power. Appropriate controls for the traffic signals, which are conventional in the art, are provided with the trailer.

In a further modification of the invention described above, multiple trailers may be provided, each carrying a traffic control signal. The trailers are attachable as an integral unit at interlocking frame elements so that they can be transported by a single towing vehicle.

The above and other objects and advantages of the present invention will become more apparent from the following description, claims and drawings in which:

FIGS. 6A–6C illustrate the steps in erecting the traffic control signal of the present invention;

Figure 1:
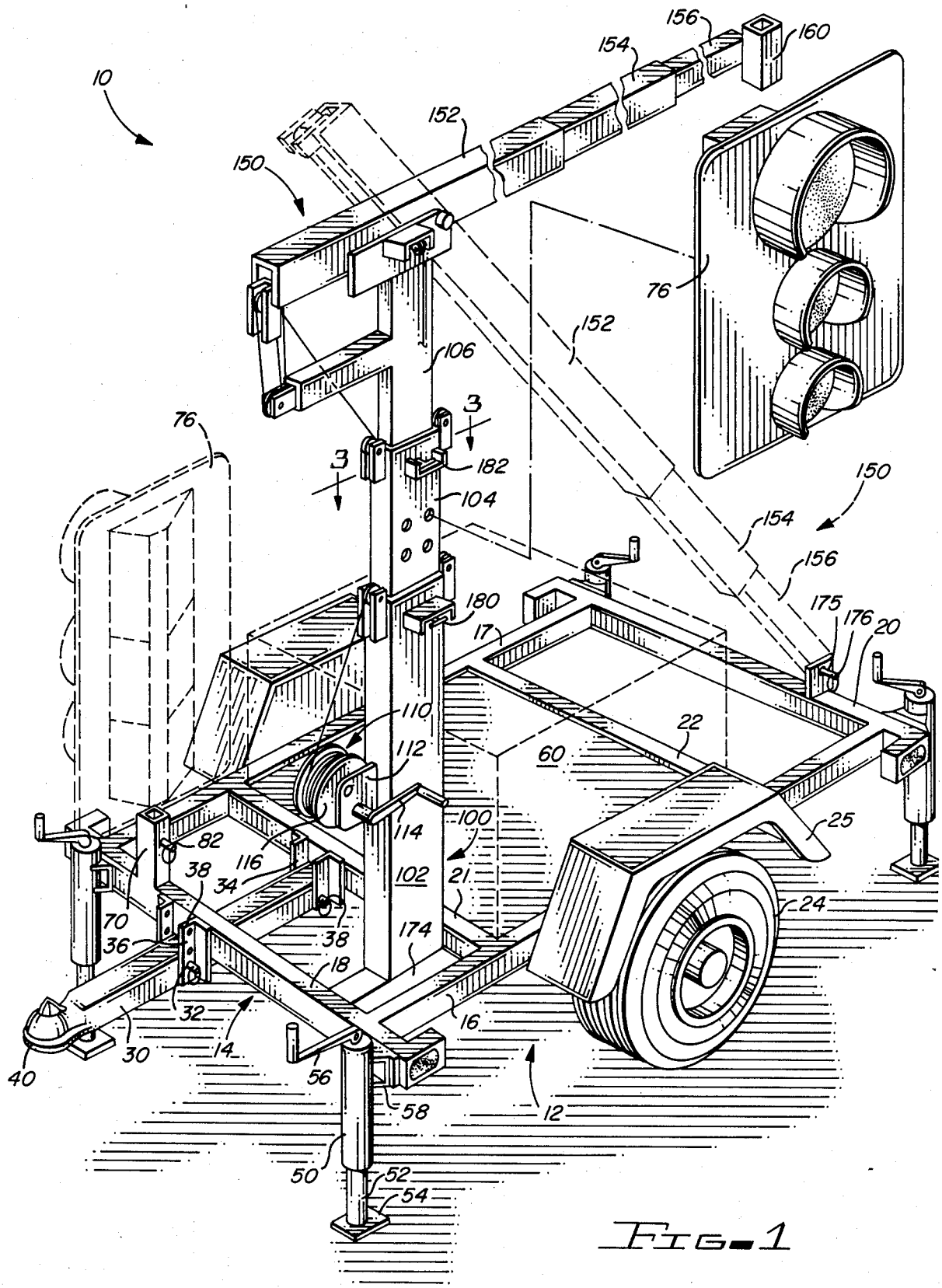
FIG. 1 is a perspective view of the traffic control signal of the present invention.

Turning now to the drawings where the same numerals are used to indicate the same or similar elements, FIG. 1 is a perspective view which shows the traffic control signal of the present invention generally designated by the numeral 10. The signal 10 includes a trailer 12 having a frame 14 consisting of longitudinally extending channels 16, 17 and transverse members 18 and 20 at the front and rear of the frame respectively. Additional transverse reinforcing members 21, 22 may also be provided at spaced apart locations extending between the longitudinal side rails 16 and 17. The frame 14 is supported on conventional axle and wheel assemblies 24 which include a pneumatic tire and suitable springs. As is conventional, fender 25 is carried on opposite sides of the frame at the wheel locations.

A pair of brackets 32, shown as angle irons, are secured to cross-member 18 at the axial centerline of the trailer in a vertical spaced-apart position. Similarly, a pair of brackets 34 are provided on frame member 21. A tongue 30 is supported at the brackets 32 and 34 by locking pins 36 and 38. The forward end of the tongue is provided with a coupling member 40 which is attachable to a conventional ball hitch as is known in the art. The vertical position of the tongue 30 can be adjusted by the moveable pins 36 and 38 and repositioning pins in the bores 38 provided in the brackets 32 and 34.

Each corner of the trailer is provided with a jack 50 having an extensible rod 52. The outer end of rod 52 is provided with a ground-engaging pad 54. The rod 52 may be extended or retracted manually by means of actuating handle 56. Preferably, each of the jacks is mounted on a bracket 58 which is rotatably mounted with respect to the frame. In this way, the jacks may be pivoted to an out-of-the-way horizontal position lying along the frame when the trailer is being transported.

A bed area 60 is provided on the trailer surface between members 21 and 22 and may be either used to mount a portable power generation unit, shown in dotted for clarity, or may be used to receive weighting in the form of sand bags as will be explained hereafter.

Figure 5:
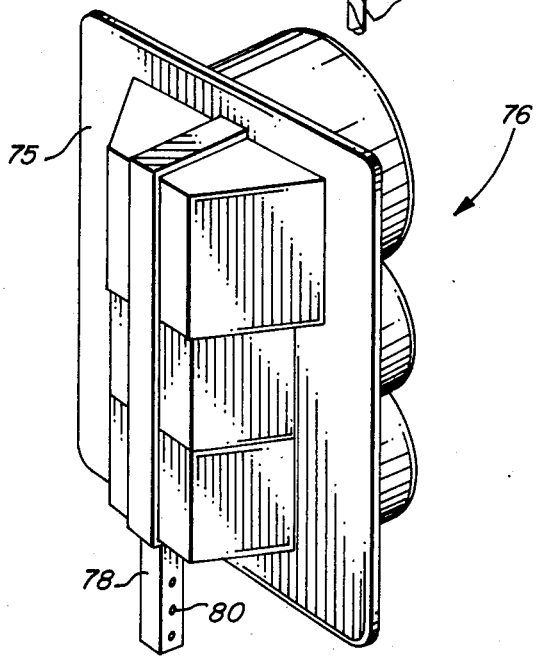
FIG. 5 is a rear perspective view of the traffic signal head attachable at the end of the boom.

An upstanding receptacle 70 is provided on frame member 18. Receptacle 70 is shown as a box channel and is used for temporary storage of the boom traffic control signal 75 in the transportation and storage position. The traffic control signal or signal head is best shown in FIG. 5. The signal head 75 is conventional and has the three control signals, red, amber and green, for standard traffic control. Alternate forms including left turn arrows or flashing signals and other types of control devices may also be used. The control device includes a downwardly extending tube member 78 which is configured to be received within upstanding receptacle 70. Holes 80 are spaced along tube 78 and adapted to receive pin 82 to temporarily lock the control head in the storage position. Various electrical connections are not shown but are well known to those in the art. Typically, the control wiring and electrical connections are made by means of four prong quick connectors. A typical control signal head is one of the type manufactured by Lexalite.

Figure 2:
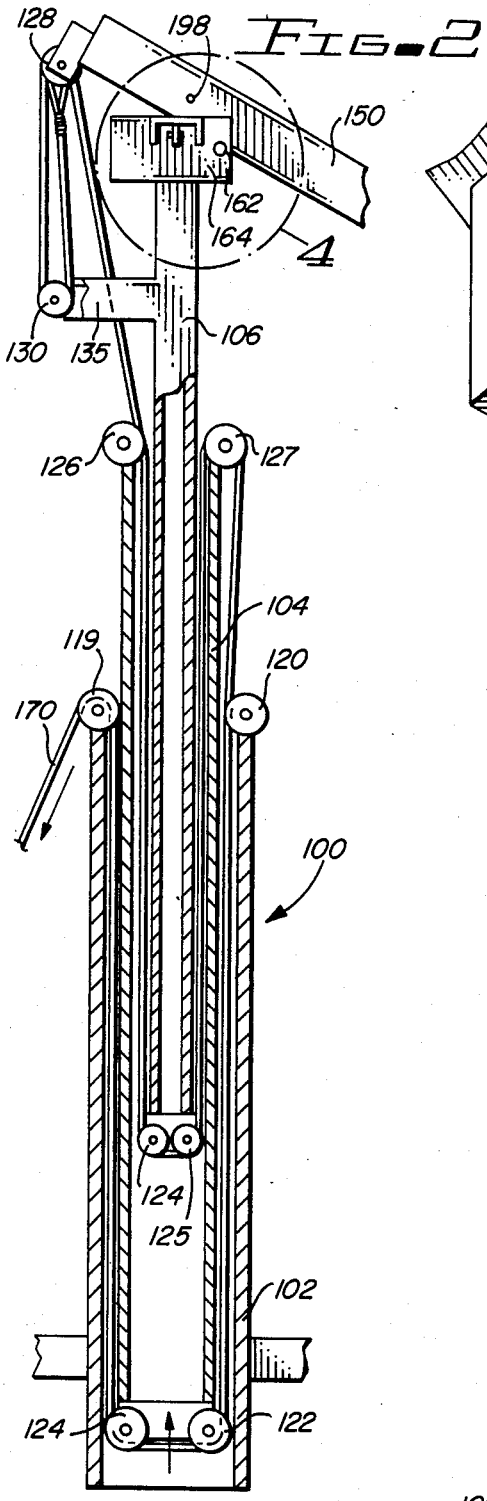
FIG. 2 is an elevational view, partly in section, of the mast assembly.

A vertical supporting column or mast 100 is secured at a forward corner of the trailer at the intersection of frame members 16 and 18. The mast assembly 100 includes a base section 102 which is shown as a box member having a generally rectangular cross-section. Base member 102 receives intermediate telescoping section 104 which, in turn, receives upper telescoping section 106. The mast assembly 100 is raised and lowered by means of a pulley assembly which is best seen in FIG. 2. The pulley assembly includes a manually operated winch 110 which is secured to base member 102 at bracket 112. The winch is manually operable by means of handle 114 through which cable reel 116 can be rotated.

Figure 3:
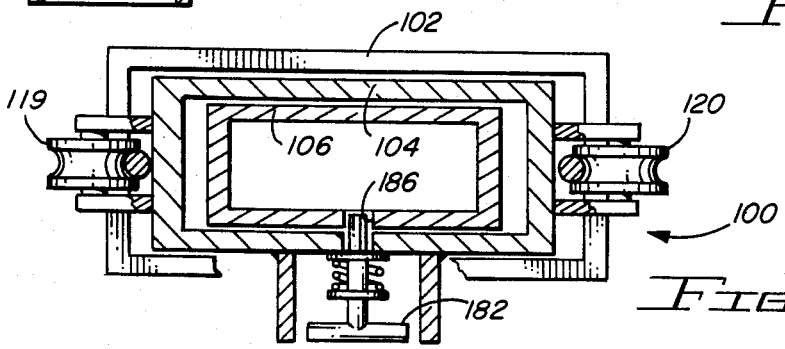
FIG. 3 is a sectional view taken along lines 3—3 of FIG. 1.

A pair of pulleys 119, 120 are mounted on brackets at the opposite side at the upper end of base section 102. A pair of pulleys 121, 122 are mounted at the inner end of intermediate section 104. Pulleys 126 and 127 are mounted on opposite sides of the upper end of intermediate mast section 104. Room 150 is pivotally secured at pivot point 162 at bracket 164 at the upper end of upper section 106. Pulleys 124, 125 are mounted at the lower end of upper section 106. Pulley 128 is secured at the end of boom 152. Pulley 130 is secured at the end of horizontal arm 135 which extends from section 106. A cable 170 extends continuously from the winch across pulley 119, around lower pulleys 121, 122, across pulley 120, around pulley 127, around the inner end of section 104 at pulleys 124, 125, across pulley 126, around pulley 128 and 130. The free end of the cable is secured at the inner end of boom 150 as best seen in FIG. 2. Thus, it will be apparent that when winch 110 is wound in a direction to take up cable 170 or reel 116, the take-up will cause intermediate telescoping section 104 to elevate within the base 102. Section 104 will continue to raise until detent member 180 locks intermediate member 104 into its fully extended position. Thereafter, continued actuation of the winch and take-up of the cable 170 will cause the upper telescoping section 106 to continue to extend until it reaches its full height at which point upper detent 182 engages an aligning bore 186 in member 106 as best seen in FIG. 3. At this point, the mast is fully extended and continual take-up of cable by the winch will cause the telescoping boom assembly 150 to rotate to the horizontal position.

The horizontal boom 150 consists of the inner base member 152 which is shown as having a generally box-like construction. Base member 152 as has been pointed out, is pivotally secured at the upper end of the mast section 106. Intermediate member 154 is telescopically extensible and retractable within member 152. The outer member 156 is, in turn, telescopic within member 154. The outer end of member 156 carries a receptacle 160 which is adapted to receive the tubular shaft on the control signal head 75. In the storage or transportation position, boom 150 assumes a position as shown in dotted in FIG. 1 with the outer end locked in place by pin 175 at bracket 176 on frame member 20. When the pin is released and the winch actuated, the vertical mast extends.

Figure 4:
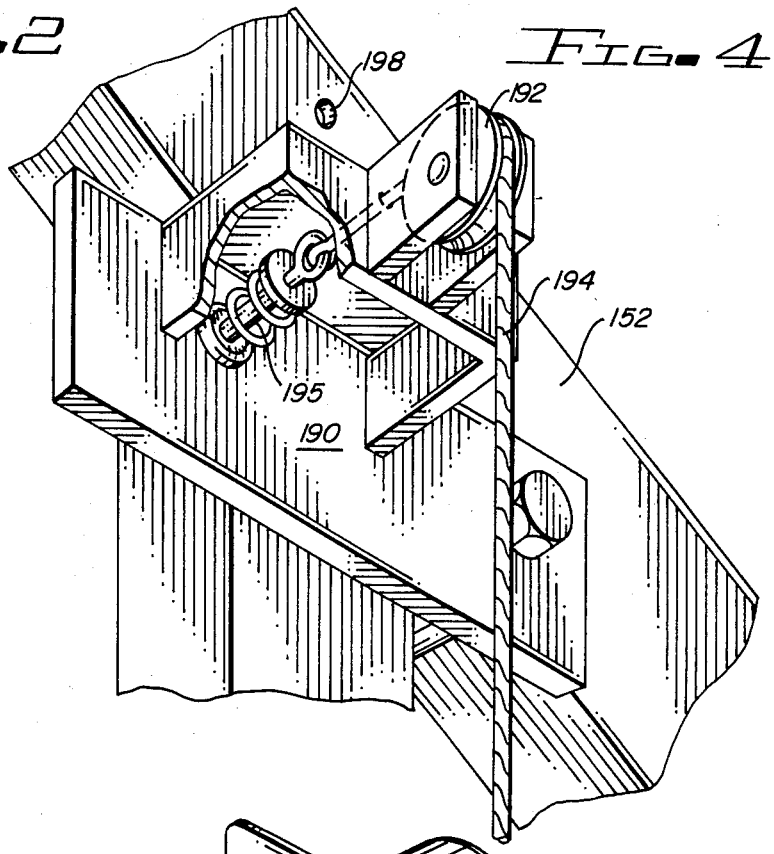
FIG. 4 is an enlarged detail view as indicated in FIG. 2.

Referring to FIGS. 6A, 6B and 6C, once mast 100 extends to its full vertical position and locks in place, telescoping boom assembly 150 will extend under influence of gravity and gradually be pivoted to the horizontal position. The control signal or control head 75 is first positioned in receptacle 160 and connected to the wiring by an appropriate connector. Continued actuation of the winch cause the boom to be pivoted to the horizontal position, and as it is raised, the weight of the boom assembly and the control head 75 will cause the boom to extend to its full length. Thereafter, as seen in FIG. 6C, the boom will assume the horizontal operating position. Thus, with the device in the position shown in FIG. 6C, two control signals are provided. One control signal 76 is on the vertical mast is at an elevation corresponding to the normal elevation for street side control signals. Control head or signal 75 at the end of the horizontal boom 150 extends outwardly to be positioned over a traffic lane. The vertical height of the boom allows clearance for vehicles passing beneath. In the horizontal position, the boom is locked in place by detent mechanism, best shown in FIG. 4. The detent includes a bracket 191 on plate 190. Bracket carries a pulley 192. A cable 194 extends across pulley 192 and is connected at its upper end to locking pin 195 which is spring biased as shown. The locking pin will engage bore 198 when the boom reaches a horizontal position. To release the horizontal boom, a downward force is exerted on cable 194 to disengage locking pin 195 from its bore.

As has been previously mentioned, a motor generator unit may be incorporated as part of the trailer on platform section 60. For purpose of clarity this has been shown in the drawings in FIG. 1 in dotted. Alternatively, the unit may include suitable power extension cable for attaching to a remote source of power.

In use, the device is pulled by a convenient towing vehicle to the temporary location. The trailer is secured to the towing vehicle at hitch 40. Once in position at the roadside, the four ground jacks 50 are extended and the device stabilized. If necessary, trailer platform 60 will accept additional weight such as sandbags for further stabilizing the device. Detent pin 175 at the outer end of the horizontal boom is released. Signal head 75 is removed from its temporary position and secured in the receptacle 160 at the end of the boom by insertion of tube 78. The user then manipulates the winch through handle 114 which causes the vertical mast sections 104 and 106 to telescopically extend as shown in FIGS. 6A and 6B. Upon full extension of the vertical mast section, the continued actuation of the winch will cause horizontal boom to extend and pivot to the horizontal position at which time the detent 190 locks in place. The device is now ready for use. The signal head 76 on the vertical mast section 104 provides a road side traffic control while the signal head 75 on the horizontal boom provides an over-the-road control for added visibility and safety. Preferably the horizontal boom is at a location approximately fifteen feet above the roadway in accordance with established highway practice, allowing suitable clearance for vehicles.

For added convenience and flexibility, the vertical mast assembly may be pivotal. As seen in FIG. 1, mast section 102 may be mounted on a turntable 175 which may be rotated to any desired angular position. This allows the trailer to be positioned at any convenient road side location and the upper end of the vertical mast and the horizontal boom pivoted to the appropriate position.

Figure 7A:
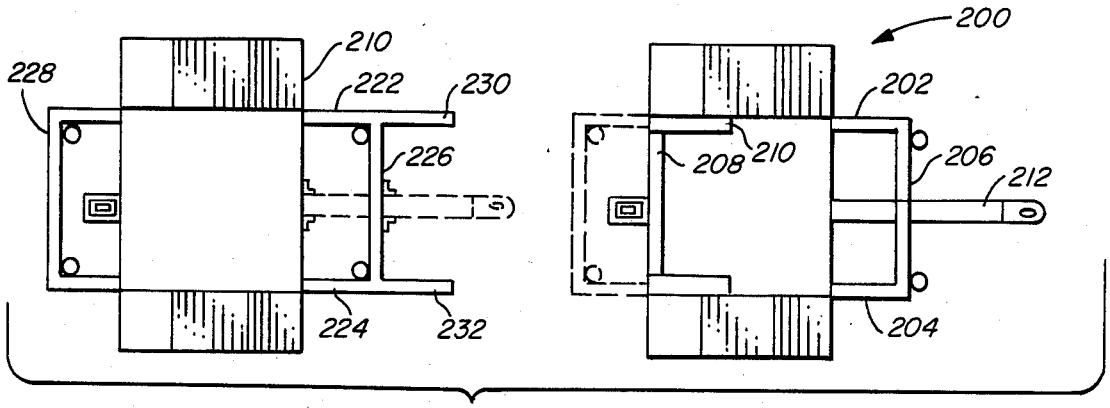
FIGS. 7A and 7B are plan views of an alternate trailer construction.
Figure 7B:
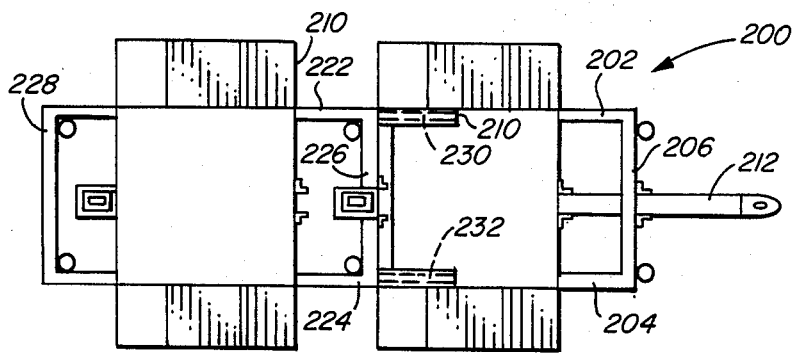
Figure 8:
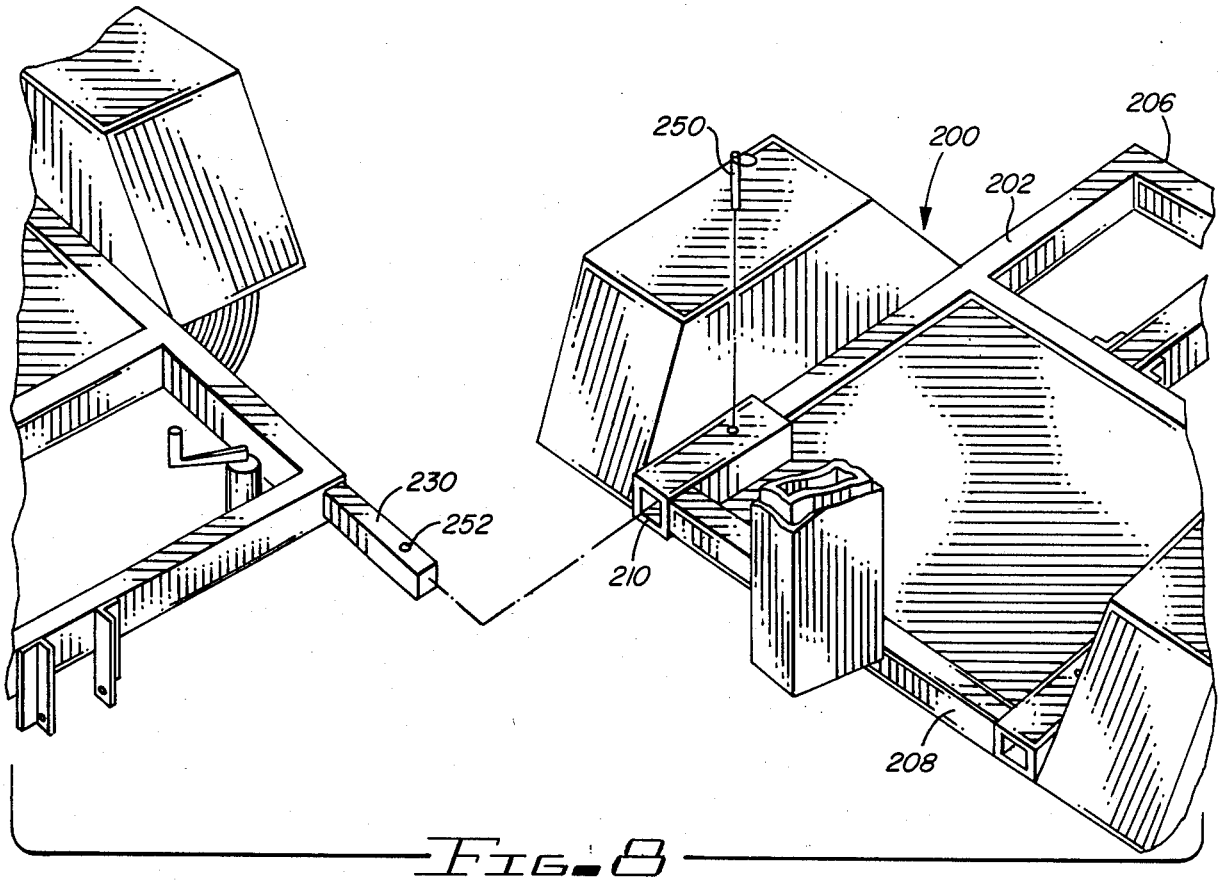
FIG. 8 is a partial perspective view showing the alternate trailer construction of FIGS. 7A and 7B.

FIGS. 7A, 7B and 8 show an alternate embodiment of the present invention, generally designated by the numeral 200.

In the embodiment shown in these figures, multiple trailer units 200 and 210 are provided. Trailer 200 is configured having a frame consisting of opposite longitudinal side frame members 202 and 204, front cross member 206 and rear cross member 208. Side members 202 and 204 are in the form of tubes having openings 210 at their rear end as best seen in FIG. 3. Trailer 200 has a tongue 212 for attachment to a towing vehicle and the trailer is supported on wheels and axles for transportation as conventional.

The arrangement shown in these figures is a bobtail trailer. In this arrangement, trailer 210 is configured having opposite longitudinal side rails 222, 224. The frame is completed by front cross member 226 and rear cross member 228. Trailer assembly 210 is again supported on a suitable wheel and axle assembly for transportation. Side rails 222 and 224 have forward projections 230 and 232 which are in the form of bars which are adapted to be received within the openings 210 at the rear of forward trailer 200. In this way, the trailers can be joined together as best seen in FIG. 7B and secured in the unitary fashion by locking pin 250 which extends through frame members 202, 204 into bore 252 in forward projections 230, 232. In this way, a pair of control signal assemblies each on separate trailers, can be unitized for transportation to the temporary location. As a unit, the trailers will comply with most state laws. When the location is reached, pin 250 can be released and the rear trailer 210 can be dropped at the appropriate temporary location. The towing vehicle can then proceed to another temporary location where the forward trailer assembly and its traffic control signal can be placed.

It will be obvious to those skilled in the art that various changes, modifications and alterations may be made to the invention disclosed herein without departing from the spirit and scope thereof and therefore the invention is not limited by the embodiments illustrated and described in the specification but only by a fair reading and interpretation of the accompanying claims.

I claim:

1. A portable traffic control signal apparatus comprising:

(a) a trailer adapted for attachment to a towing vehicle;

(b) a vertical telescopic mast assembly on said trailer, said vertical mast assembly carrying a first traffic signal assembly;

(c) a telescopic boom assembly pivotally secured to said mast assembly and assuming a non-horizontal position in a non-use condition, said boom being movable to a horizontal position of use;

(d) a second traffic signal assembly detachably secured to said boom assembly;

(e) actuation means operatively connected to said boom and mast for simultaneously extending said mast and said boom and thereafter rotating said boom to a horizontal position; and (f) means for locking said boom in a horizontal position.

2. The apparatus of claim 1 further including a portable power generating apparatus operatively connected to said first and second signal lights.

3. The apparatus of claim 1 wherein said actuating means comprises a manual cable and pulley system, said cable system first erecting said mast and boom assembly to their fully extended position and thereafter pivoting said boom assembly to a substantially horizontal position.

4. The apparatus of claim 1 further including a second trailer having a telescoping vertical mast assembly and a telescoping boom assembly carried on said mast assembly, each of said boom and mast assemblies including a traffic control signal and further including means for detachably securing said first and second trailers in a unitary condition for towing.

5. The apparatus of claim 1 wherein said mast includes a plurality of telescopic sections and detent means for locking said telescopic sections in a predetermined extended position.

* * * * *